United States Patent [19]

Wright

[11] 3,983,641

[45] Oct. 5, 1976

[54] SHOE GUARD

[75] Inventor: James Wright, St. Albans, N.Y.

[73] Assignee: Lawrence Peska Associates, Inc., New York, N.Y. ; a part interest

[22] Filed: Aug. 20, 1975

[21] Appl. No.: 606,218.

[52] U.S. Cl. ..... 36/72 B

[51] Int. Cl.[2] ..... A43B 13/22

[58] Field of Search ..... 36/72 R, 72 B, 7.1, 36/7.3

[56] References Cited

UNITED STATES PATENTS

| | | | |
|---|---|---|---|
| 1,585,856 | 5/1926 | Headley | 36/72 B |
| 1,794,035 | 2/1931 | Schonfeld | 36/72 R |
| 1,820,679 | 8/1931 | Sawyer | 36/72 B |
| 1,955,159 | 4/1934 | Winget | 36/72 B |
| 2,901,842 | 9/1959 | DeLucia | 36/72 R |

*Primary Examiner*—Alfred R. Guest

*Attorney, Agent, or Firm*—Jack D. Slobod

[57] ABSTRACT

A guard for protecting the rear half of a shoe from scuffing during driving is an open-toed overshoe which includes a base portion lying under the heel and rear portion of the sole of the shoe. A wall upstanding around the periphery of the base and hugging the rear half of the shoe upper includes a pair of tabs which are snap fastened in overlapping relationship over the instep.

1 Claim, 3 Drawing Figures

SHOE GUARD

FIELD OF THE INVENTION

The present invention relates generally to shoe and heel protectors for protecting a shoe from scuffing during driving. In its particular aspects the present invention relates to an open-toed overshoe dimensioned to cover the rear half of a shoe.

BACKGROUND OF THE INVENTION

Various heel protectors and shoe protectors have heretofore been proposed for protecting a shoe from scuffing against the floor mat of a vehicle during driving. Unfortunately, to my knowledge, none of these proposed designs has gained any significant use. It is believed that the same reason for this lack of use is that the designs previously proposed were not capable of covering sufficient surface area of a shoe to adequately protect against scuffing.

OBJECTS OF THE INVENTION

It is an object of the present invention to provide a shoe protector capable of protecting adequate surface area of a shoe against the scuffing abrasions occurring during driving.

It is a further object of the present invention to provide a simple and inexpensive shoe protector which is easily taken on and off.

SUMMARY OF THE INVENTION

Briefly, the aforementioned and other objects of the present invention are satisfied by providing an open-toed overshoe for substantially completely covering the rear half of a shoe to cover sufficient surface area of the shoe to insure protection against scuffing of the shoe while driving.

For easy removal, a pair of tabs projecting from sides of the overshoe overlap over the instep of the shoe, and are fastened together by mutually engageable fasteners.

Other objects, features, and advantages of the present invention will become apparent upon perusal of the following detailed description of the preferred embodiment thereof when taken in conjunction with the appended drawing wherein:

FIG. 1 is a side view of the shoe protector of the present invention in use; and FIGS. 2 and 3 are similar pictorial presentations of the shoe protector in FIG. 1 illustrating the manner in which it is taken on and off the shoe.

DETAILED DESCRIPTION

Figure 1:
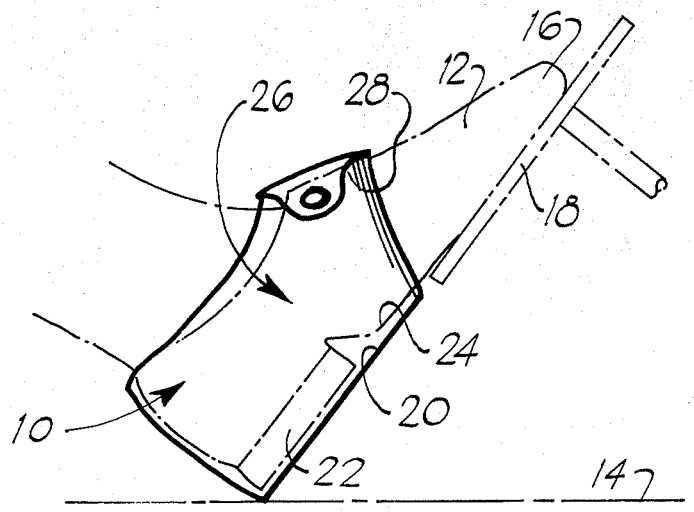
Figure 2:
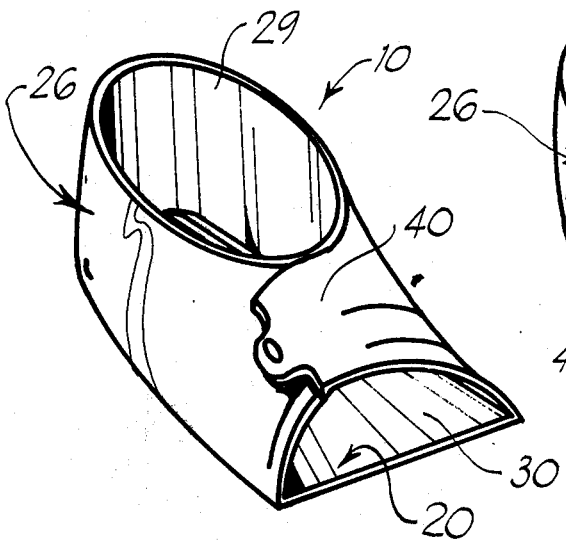
Figure 3:
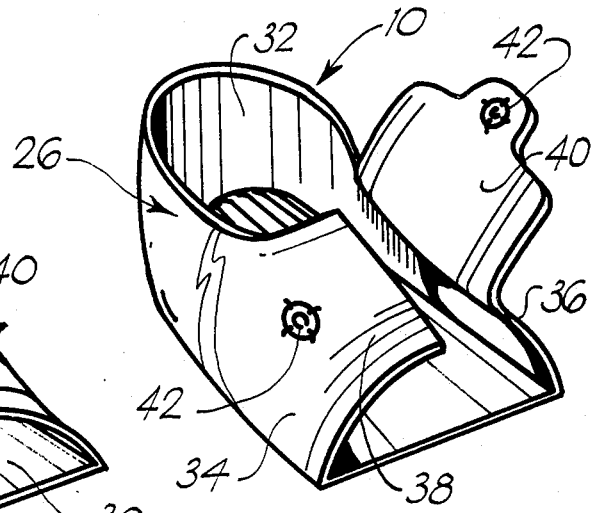

Referring to FIGS. 1 through 3 of the drawing, the shoe protector 10 of the present invention comprises a covering over the rear half of a shoe 12 to protect the shoe from scuffing on the floor 14 of a vehicle as the shoe is inclined for the toe 16 thereof to press control pedal 18. Shoe protector 10, which comprises a one-piece rubber, plastic or leather sheet of substantially uniform thickness, includes a base sheet 20 of a size to extend along the underside of the heel 22 and a rear portion 24 of the sole of shoe 12. Rubber or other resilient material is preferable to permit the protector 10 to be stretched around shoe 12 and to permit adjustment to a range of sizes of the shoe.

Shoe protector 10 further comprises a top portion 26 extending upwards around the periphery of base sheet 20. Top portion 26 is wrapped around the rear half of the shoe 12 upper and covers the instep 28 of the shoe. Top portion 26 includes an ankle opening 29 and a toe opening 30.

As best shown in FIG. 3, the top portion 26 is formed by a wall projecting upward around the periphery of base sheet 20. The wall comprises a curved rear portion 32 merging into a pair of opposed generally straight side portions 34 and 36. A pair of tabs 38 and 40 extend upwards respectively from side portions 34 and 36. The tabs 38 and 40 are of sufficient length to overlap, and when overlapped, the tabs cover instep 28 defining ankle opening 29 and toe opening 30.

The abutting faces of tabs 38 and 40 are provided with mutually engageable fasteners 42 which interlock upon pressing the tabs together. Fasteners 42 may be snap fasteners, as illustrated in the drawing, or may be mutually adhering sheets of hook or hook and eye fasteners available under the trademark VELCRO. The provision of fasteners which are pressed together for engagement and peeled apart for disengagement permits the shoe protector 10 to be easily and rapidly installed on or removed from shoe 12.

It should now be apparent that what has been described is a shoe protector 10 which generally comprises an open-toed overshoe for covering the entire rear half of a shoe to absolutely obviate the scuffing of the shoe while driving. It should further be appreciated that the preferred embodiment of the shoe protector 10 has been described in great detail. Further, numerous modifications, additions and omissions in the details herein described and illustrated are possible within the intended spirit and scope of the invention.

What is claimed is:

1. A shoe protector for covering the rear half of a shoe; said shoe protector comprising: a unitary sheet of substantially uniform wall thickness said sheet comprising a base portion dimensioned to lie under the heel and the rear of the sole of a shoe; a rear portion upstanding around the rear periphery of said base portion; a pair of opposed side portions respectively upstanding from opposite sides of the periphery of said base portion and merging into said rear portion; said rear and side portions being dimensioned to cover the rear half of the upper of said shoe; said side portions respectively including a pair of tabs overlappable over the instep of said shoe; said tabs when mutually overlapped defining an ankle opening and a toe opening; and mutually engageable fastening means on said tabs comprising means for interlocking in response to pressing said tabs together.

* * * * *